US007048674B2

(12) United States Patent
Hartman et al.

(10) Patent No.: US 7,048,674 B2
(45) Date of Patent: May 23, 2006

(54) HANDHELD HAND, WRIST AND ARM EXERCISE AND REHABILITATION DEVICE

(76) Inventors: Ronald P. Hartman, 1268 Exchange St., Alden, NY (US) 14004; Donald P. Hartman, 588 Como Park Blvd., Cheektowaga, NY (US) 14227

( * ) Notice: Subject to any disclaimer, the term of this patent is extended or adjusted under 35 U.S.C. 154(b) by 316 days.

(21) Appl. No.: 10/178,816

(22) Filed: Jun. 24, 2002

(65) Prior Publication Data

US 2003/0004041 A1 Jan. 2, 2003

Related U.S. Application Data

(60) Provisional application No. 60/301,764, filed on Jun. 28, 2001.

(51) Int. Cl.
*A63B 23/14* (2006.01)
*A63B 21/06* (2006.01)

(52) U.S. Cl. ..... 482/46; 482/93

(58) Field of Classification Search ..... 482/93, 482/105, 44–50, 106–109
See application file for complete search history.

(56) References Cited

U.S. PATENT DOCUMENTS 2,263,135 A * 11/1941 Johnson ..... 482/50
4,345,756 A * 8/1982 Hoagland ..... 482/109
4,351,526 A * 9/1982 Schwartz ..... 482/108
5,060,933 A 10/1991 Cedro
5,110,119 A * 5/1992 Arnold ..... 482/93
5,281,192 A * 1/1994 Nelson ..... 482/93
5,312,209 A 5/1994 Fox
5,435,800 A * 7/1995 Nelson ..... 482/108
5,957,813 A 9/1999 MacDonald

* cited by examiner

*Primary Examiner*—Gregory L. Huson
*Assistant Examiner*—Fenn C. Mathew
(74) *Attorney, Agent, or Firm*—Jaeckle Fleischmann & Mugel, LLP

(57) ABSTRACT

A handheld device for exercising, rehabilitating and/or strengthening the muscles, tendons and ligament in the hands, wrists and/or forearm, as well as enabling the simultaneous improvement in the full range of motion in these regions. The device includes an elongated adjustable locking member having a lower cushioned hand pad portion and an upper hand pad base, adjustably connected to an elongated finger grip bar. The finger grip bar has a finger grip receiving edge and a post attached to this edge for slidably receiving weights. The device enables the wrists, hands and forearms to work together, enabling the user to exercise an injured or surgically repaired wrist, hand or forearm with the assistance of the uninjured wrist, hand or forearm, thereby reducing the overall duration of time needed for rehabilitation and recovery.

7 Claims, 7 Drawing Sheets

HANDHELD HAND, WRIST AND ARM EXERCISE AND REHABILITATION DEVICE

CROSS-REFERENCE TO RELATED APPLICATIONS

This application claims the benefit of U.S. Provisional Patent Application Ser. No. 60/301,764, filed Jun. 28, 2001.

TECHNICAL FIELD

The present invention relates generally to an exercise device, and in particular, to a handheld hand, wrist and forearm exercising, strengthening and rehabilitation device.

BACKGROUND OF THE INVENTION

Injuries to the hand, wrist and/or forearms (e.g. carpal tunnel syndrome, surgically repaired wrists and the like) typically require prolonged periods of physical therapy and rehabilitation in an attempt to fully recover and reclaim full strength and improved range of motion to the injured muscles, tendons and ligaments in the affected areas. There is currently a great need for a handheld hand, wrist and forearm rehabilitative device that facilitates a user's ability to recover full strength and full range of motion to the injured region. There is also a great need for handheld exercising device that facilitates the strengthening and the full range of motion in the hands, wrists and forearms for users who exercise with the device, enabling users to deliver more strength and increased range of motion in athletic activities that require such capabilities, including, but not limited to golf and tennis.

Numerous hand, wrist and forearm exercising and rehabilitating devices are provided in the prior art. A few examples of such devices include U.S. Pat. No. 5,060,933 issued to Cedro; U.S. Pat. No. 5,957,813 issued to Macdonald; and U.S. Pat. No. 5,312,309 issued to Fox. Despite the great variety of exercising and rehabilitative devices available there remains a need for a handheld device capable of providing users with a means of strengthening the muscles, ligaments and tendons of an injured wrist, hand or forearm with the support of the healthy wrist, hand or forearm, while simultaneously improving the full range of motion.

Additionally, there remains a need for a handheld device that will shorten the duration of rehabilitation time typically required for rehabilitating an injured hand, wrist and/or forearm, and enable the user to substantially regain full strength and range of motion to the injured region. There is also a need for an exercise device the will enable a user to strengthen and build muscles, as well increase the full range of motion for the user's hands, wrists and/or forearms by engaging in exercising protocols that use the handheld device.

None of the prior art devices which applicants are aware of describes a handheld hand, wrist and/or forearm exercising, strengthening and rehabing device as disclosed and claimed herein.

SUMMARY OF THE INVENTION

Accordingly, it is a principal object of the present invention to provide a handheld device for exercising, rehabilitating and/or strengthening the muscles, tendons and ligaments in the hands, wrists and/or forearm, while simultaneously enabling the user to substantially attain the full range of motion in the affected regions. In a preferred embodiment, the device includes an elongated adjustable locking member having a lower cushioned hand pad portion and an upper hand pad base, adjustably connected to an elongated finger grip bar. The finger grip bar has a finger grip receiving edge and a post attached to this edge for slidably receiving weights.

It is another object of this invention to provide a handheld device that enables a user's wrists, hands and forearms to work together, so that the injured or surgically repaired wrist, hand or forearm can be exercised with the assistance of the uninjured wrist, hand or forearm, thereby strengthening and reading the injured region while simultaneously facilitating the full range of motion of the injured region, and reducing the overall duration of time needed for rehabilitation and recovery.

An additional object of the present invention is to provide a handheld device having a hand lock down pad for stabilizing a user's hands while using the device, thereby enhancing the user's ability to use the device throughout a full range of motion exercises.

It is a further object of this invention to provide improved elements and arrangements thereof for the purposes described which are inexpensive, dependable and fully effective in accomplishing its intended purposes, and are capable of overcoming the above identified problems associated with prior art exercising devices.

These and other objects of the present invention will become readily apparent upon further review of the following specification and drawings.

BRIEF DESCRIPTION OF THE DRAWINGS

The invention will be described in greater detail with reference to the accompanying drawings, which illustrate preferred embodiments of the invention, and wherein.

Corresponding reference characters indicate corresponding parts throughout the several views. The examples set out herein illustrates preferred embodiments of the invention, in one form, and such examples are not to be construed as limiting the scope of the invention in any manner.

DESCRIPTION OF THE PREFERRED EMBODIMENTS

Figure 1:
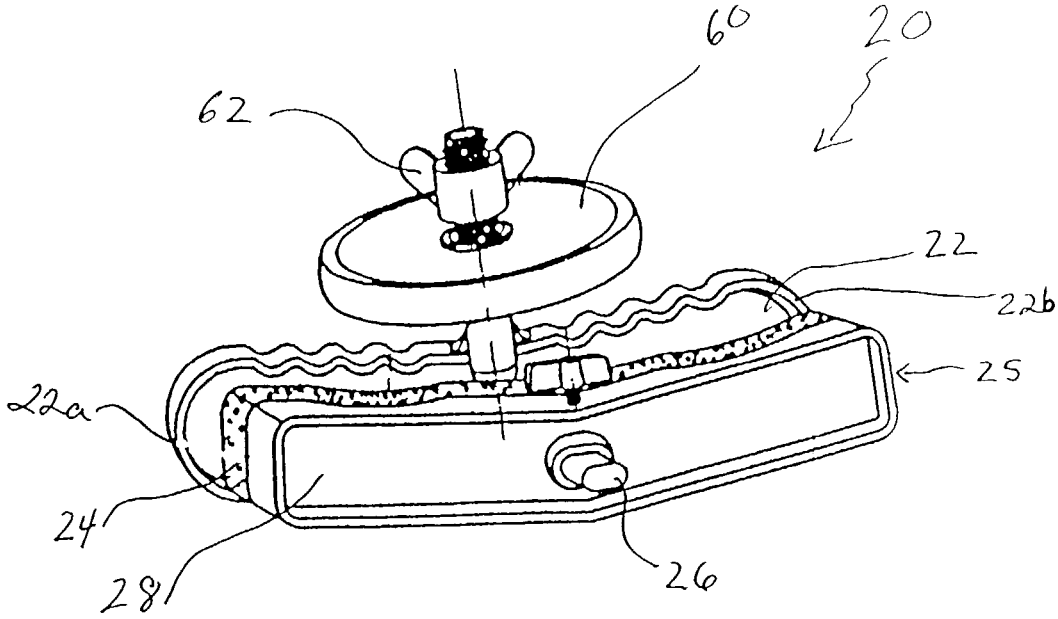
FIG. 1 depicts a perspective view of the device according to one embodiment of the present invention.
Figure 2:
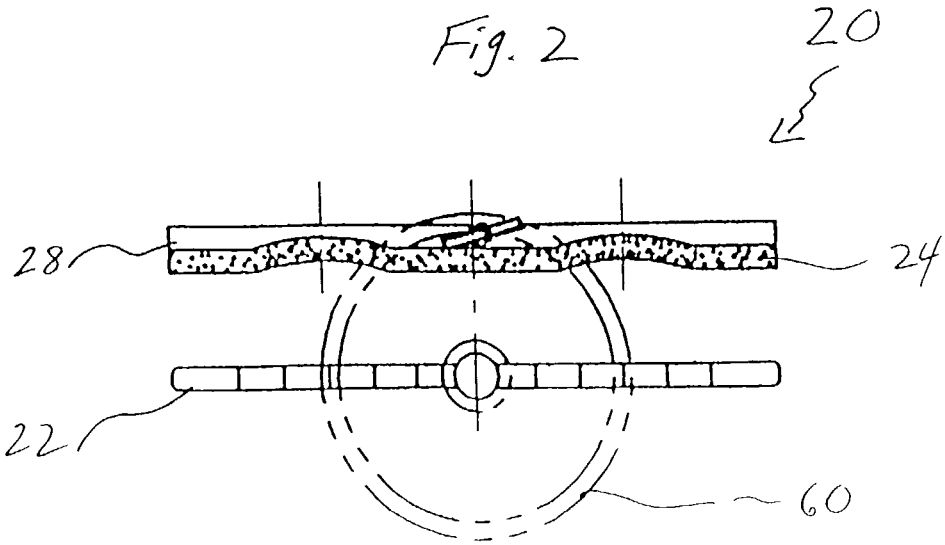
FIG. 2 depicts a cross-sectional side view of the device depicted in FIG. 1.

With reference to FIGS. 1–3, 4*a*, 4*b*, 5*a*, 5*b*, and 6-9 the handheld hand, wrist and/or forearm exercising, strengthening and/or rehabilitation device of the present invention is referred to generally by reference numeral 20, (hereinafter referred to simply as the "device").

Figure 3:
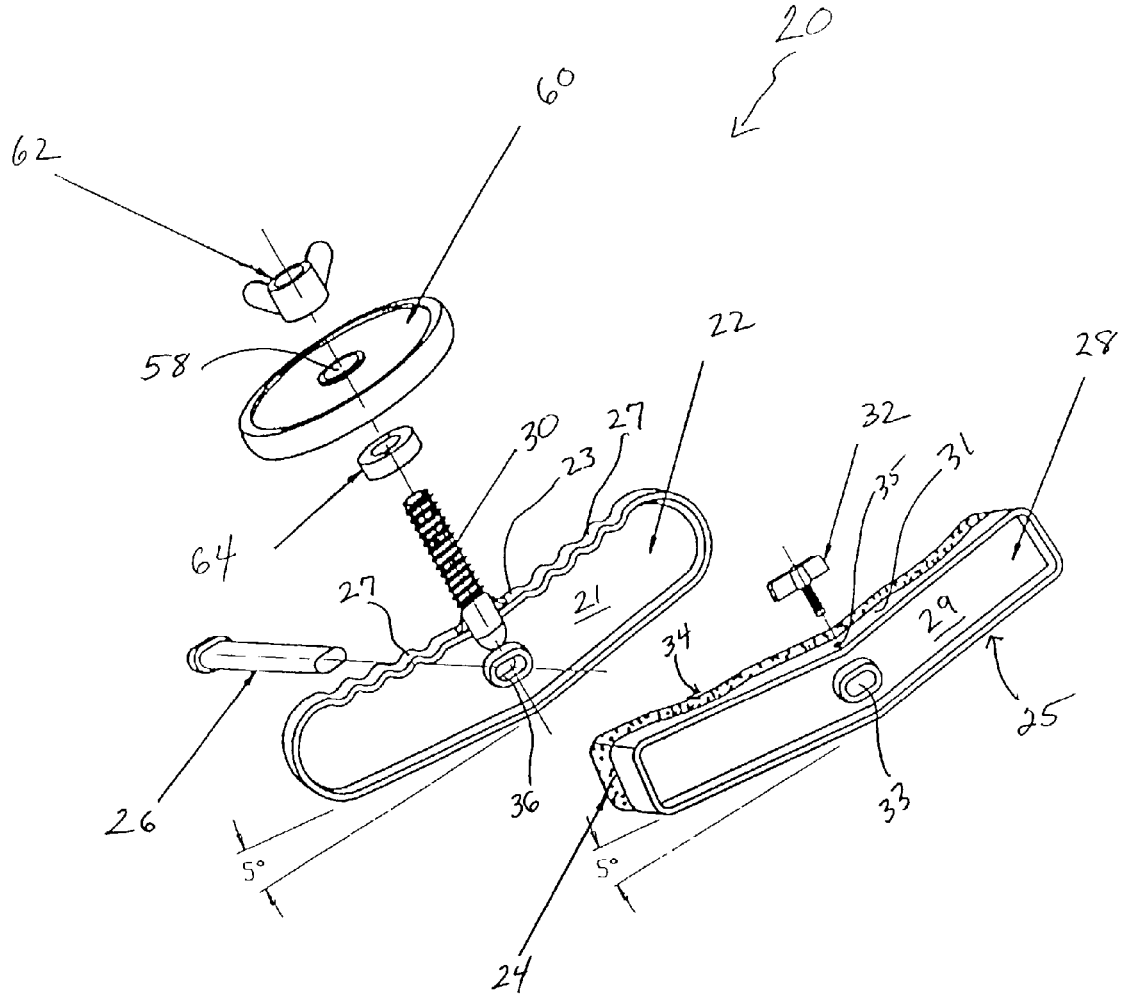
FIG. 3 depicts an exploded side view of the device depicted in FIG. 1.

FIGS. 1–3 and 6–9 depict devices 20 and 40 including an adjustable elongated hand locking bar 25 having an inner surface 34, an outer surface 29, an outer edge surface 31, a lower cushion hand pad portion 24 (also referred to as a hand lock down pad) and an upper hand pad base 28. Adjustable locking bar 25 is adjustably attached to an elongated finger grip bar 22 by a connecting post 26. As depicted in FIG. 3, connecting post 26 is inserted into hole 33 and hole 36. Adjustable locking bar 25 has an undulating inner surface 34 on the lower cushion hand pad 24. Undulating surface 34 is generally arched or curved shaped to conform to the general contours on top of a user's hand, thereby promoting a snug, hand lock down fit between the tops of a user's hand and undulating inner surface 34.

Figure 6:
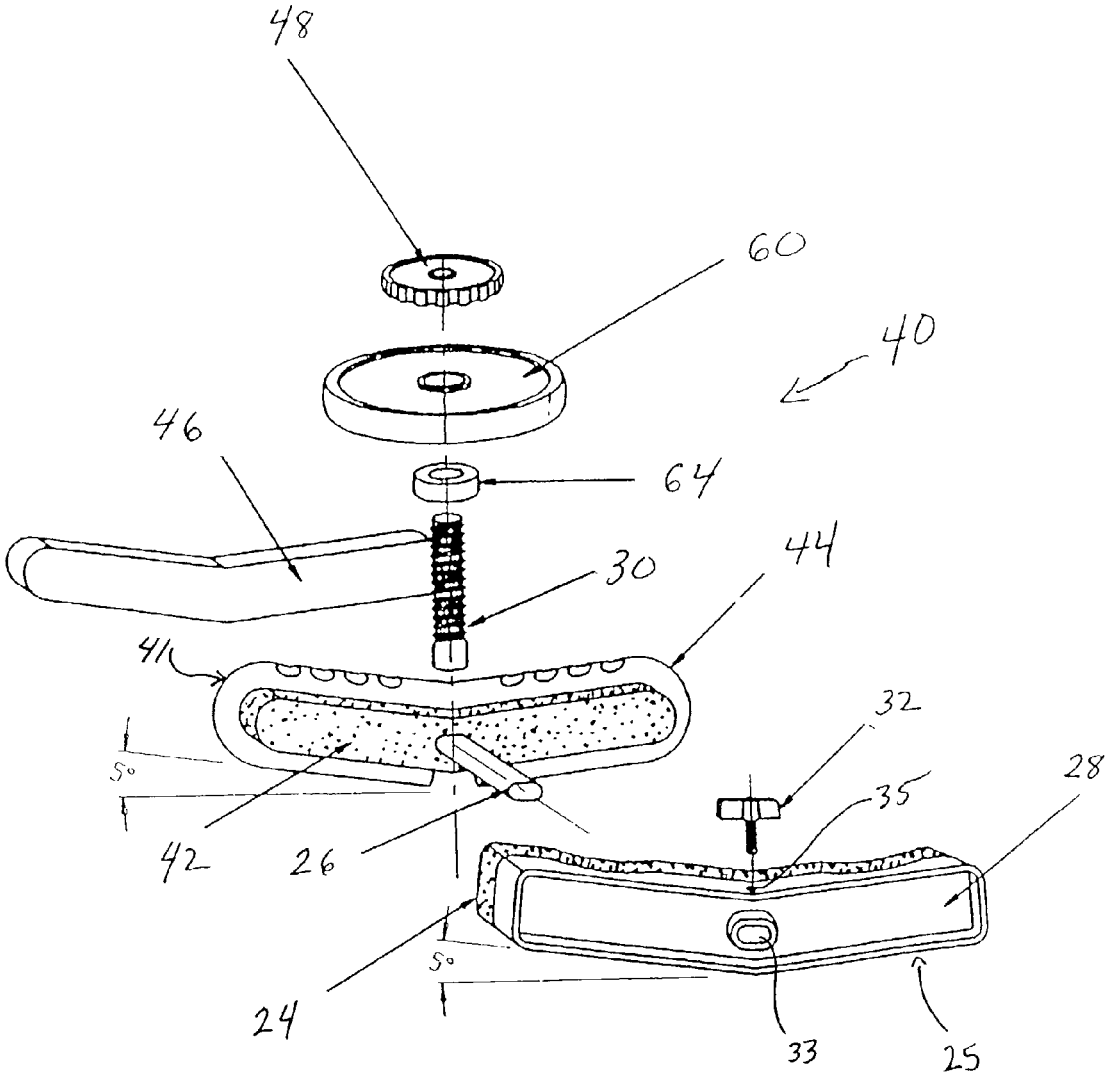
FIG. 6 depicts an exploded side view of the device according to an alternative embodiment of the present invention.

Finger grip bar 22 has an inner surface 21, an outer surface and an outer edge surface 23. Connecting post 26 is preferably centrally mounted on inner surface 42 of finger grip bar 44 as depicted in FIG. 6 or through a hole 36 as depicted in FIG. 3, and connects finger grip bar 22 to adjustable locking bar by a connecting post receiving hole 33 centrally located in adjustable hand locking bar 25. Hole 33 provides communication between the outer and inner surfaces of hand locking bar 25.

As depicted in FIGS. 3 and 6, elongated finger grip bar 22 and locking bar 25 preferably have a slight general V-shape, having about a 5° angle from the top of the V to the outermost sides of the V.

As depicted in FIGS. 3 and 6, locking bar 25 is adjustably attached to connecting post 26 by a hand locking bar threaded nob 32 or other similar such locking means, and received in a threaded nob receiving hole 35 located on outer edge 31. Hole 35 connects outer edge 31 to connecting post receiving hole 33 such that when threaded nob 32 is operably placed within threaded hole 35, then rotated and tightened within hole 35, adjustable locking bar 25 becomes firmly secured to post 26. In an alternative embodiment (not shown) connecting post 26 is capped by a stop washer or other similar such stopping device, such that adjustable locking bar 25 remains securely attached to post 26 in the event that knob 32 fails or is not properly tightened.

Edge surface 23 of finger grip bar 22 has an undulating finger separation hand grip region 27 for enabling a user to securely and comfortably grip device 20 with each finger. Edge surface 23 has mounted thereto preferably on the same side as the undulating hand grip region 27 is located, a weight connecting post 30 that extends out and away from grip region 27, for slidably receiving a weight 60. Post 30 is preferably threaded such that weight 60 is securely attached thereto by a threaded locking attachments or other similar such attachment means. FIG. 9 depicts an alternative embodiment of device 20 wherein weights 60 are mounted on ends 22*a*,22*b* of finger grip bar 22, in a manner similar to how weight 60 is slidably mounted on post 30, depicted in FIGS. 1–3 and 6–8.

Device 20 includes one or more, preferably disc-shaped weights 60, wherein each disc-shaped weight 60 is preferably of a different weight size, and has a center hole 58 sized to fit over weight connector post 30, but will not slide past stop washer 64, or other similar such stopping means. Weight 60 is securely retained on post 30 between stop washer 64 and a wing nut 62 or other similar such threaded locking device, such as locking collar 48 depicted in FIG. 6, by securely tightening wing nut 62 up against weight 60. Device 20 can also use standard weights commonly used in weight lifting sets typically found in homes, gyms and work out centers instead of weight 60.

Figures 7, 8:
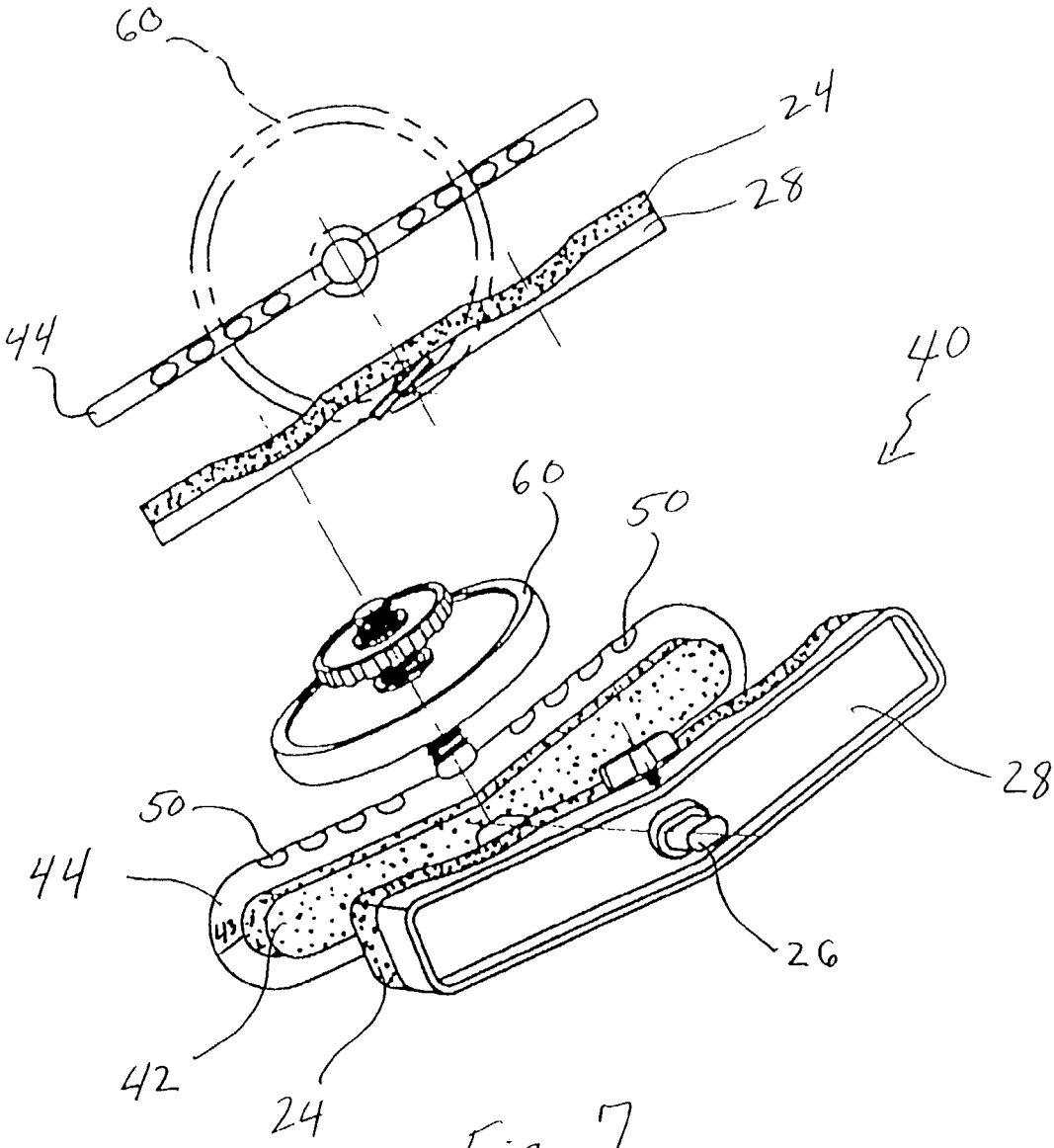
FIG. 7 depicts a perspective view of the device according to FIG. 6.
FIG. 8 depicts a cross-sectional side view of the device according to FIG. 7.
Figure 9:
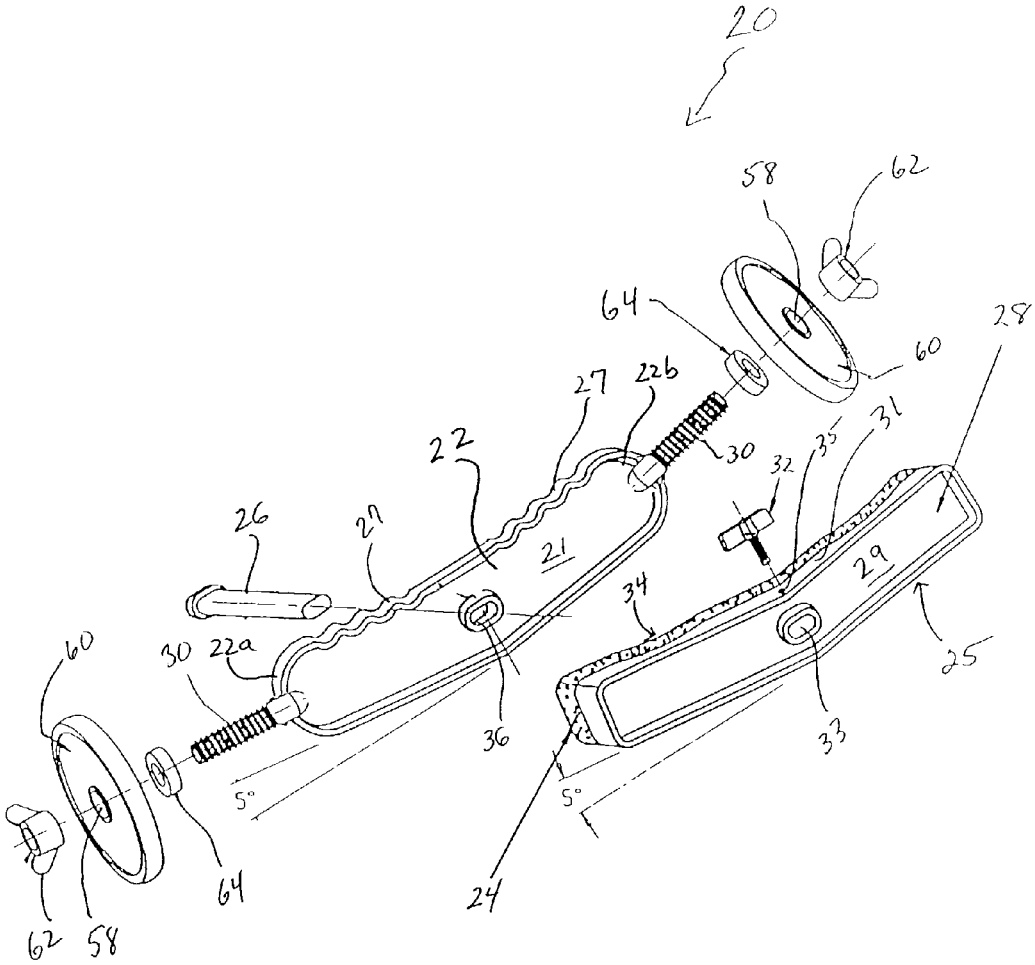
FIG. 9 depicts an exploded side view of the device according to an alternative embodiment of the present invention.

FIGS. 6–8 depict alternate embodiments of device 40, wherein finger grip bar 44 has a cushion hand pad 42 located on lower surface 43. Finger grip bar 44 also preferably has mounted on outer side 41 an elongated support bar 46 having substantially the same shape as finger grip bar 44, for providing device 40 with additional weight evenly dispersed along outer side 41 of finger grip bar 44.

Devices 20 and 40 are preferably used in attaining full range of motion, as well as developing, exercising, rehabilitating, and strengthening the muscles, tendons, and ligaments of the hands, wrists and forearms. FIGS. 4*a*, 4*b*, 5*a* and 5*b* depict preferred exercising regimens for using devices 20 and 40 in order to achieve these desired physical improvements.

FIGS. 4*a*, 4*b*, 5*a* and 5*b* depict user 100 preferably using device 20 in the sitting position with the thighs and forearms parallel to the floor. Although not depicted here, it is preferable that user 100 keep both knees together. Each hand (A,B) slides in between finger grip bar 22 and adjustable cushioned hand pad 24, wherein the fingers wrap around finger grip undulation region 27 to form a relatively tight grip. It is preferable that the back portion of the hand (that side of the hand opposite the palms, known as the dorsal side) remains in contact with cushioned hand pad 24 while devices 20 and 40 are in use in order to provide stability throughout a full range of motion exercises. Hand pad 24 also enables devices 20 and 40 to be used without user 100 actually gripping bar 22, if due to in jury and the like, user 100 is unable to grip with one or both hands. (not shown)

Figure 4A:
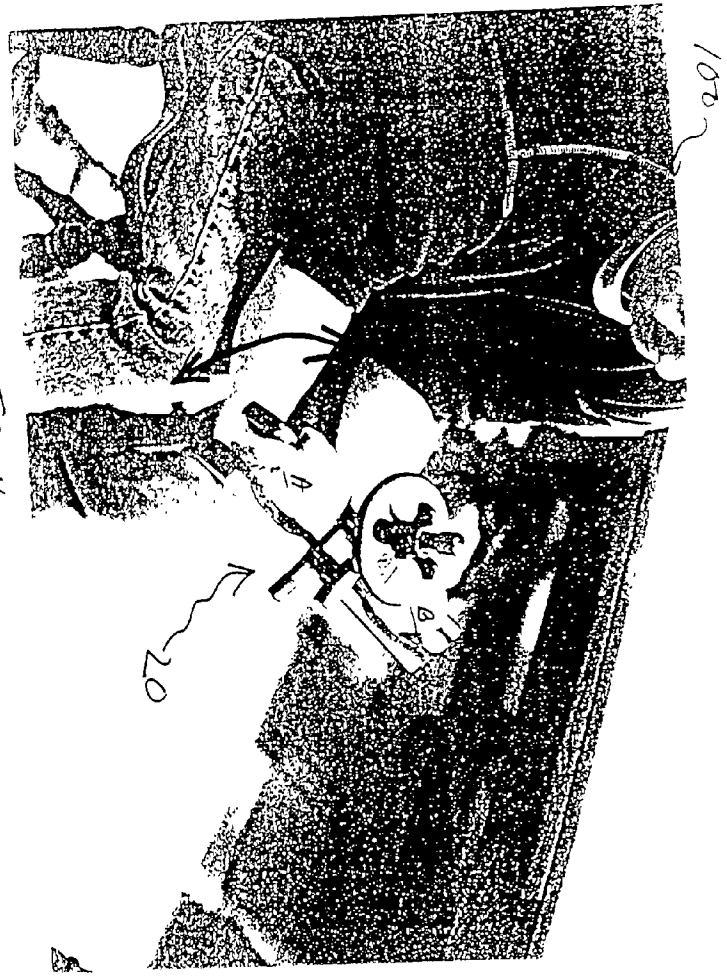
FIGS. 4*a* and 4*b* depict environmental perspective views of one embodiment of the device according to the present invention being used in one set of an exercising protocol in the "palms up" position.
Figure 4B:
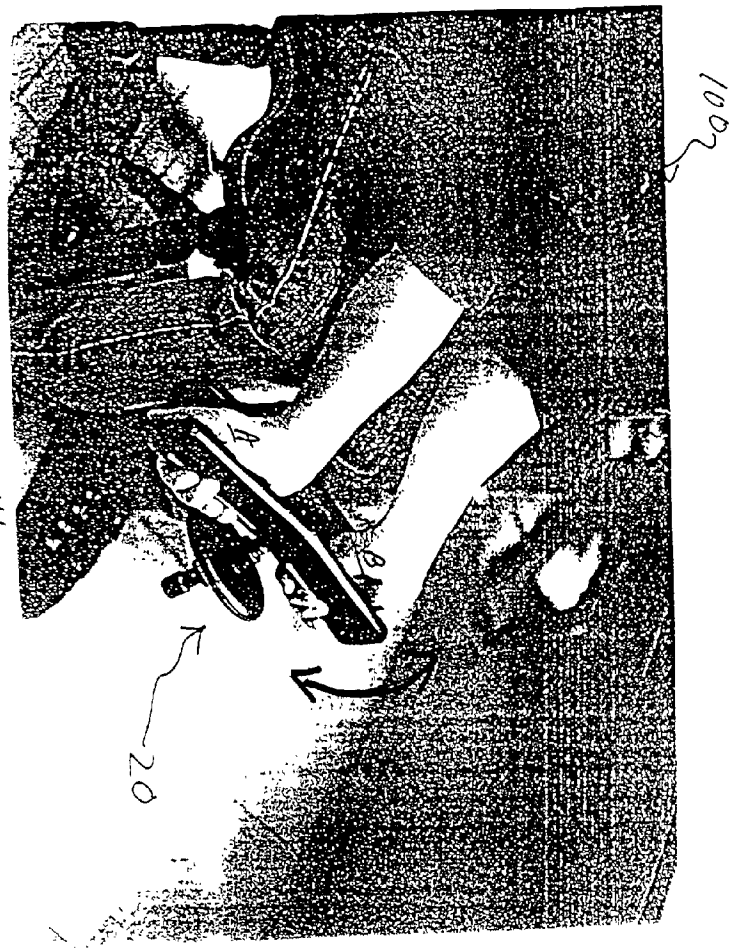

As depicted in FIGS. 4*a*, 4*b*, 5*a* and 5*b* when using device 20, user's 100 elbows are placed on or about the location of the knees as shown, and without, lifting the elbows out of position and off the knees, device 20 is slowly brought towards user's 100 chest using an upward rotation of wrists A, B as depicted in FIG. 4*a*. Wrists A, B are then slowly rotated downward, towards the floor, as depicted in FIG. 4*b*. FIGS. 4*a* and 4*b* depict user's 100 palms in the "up" position, where the palms are facing "upwards" towards the ceiling or sky. When device 20 is used in an exercise regimen wherein the palms are in the "palms up" position, the muscles, tendons and ligaments located on the inside or lower portion of the forearms, hands and wrists A, B are exercised and strengthened.

Figure 5A:
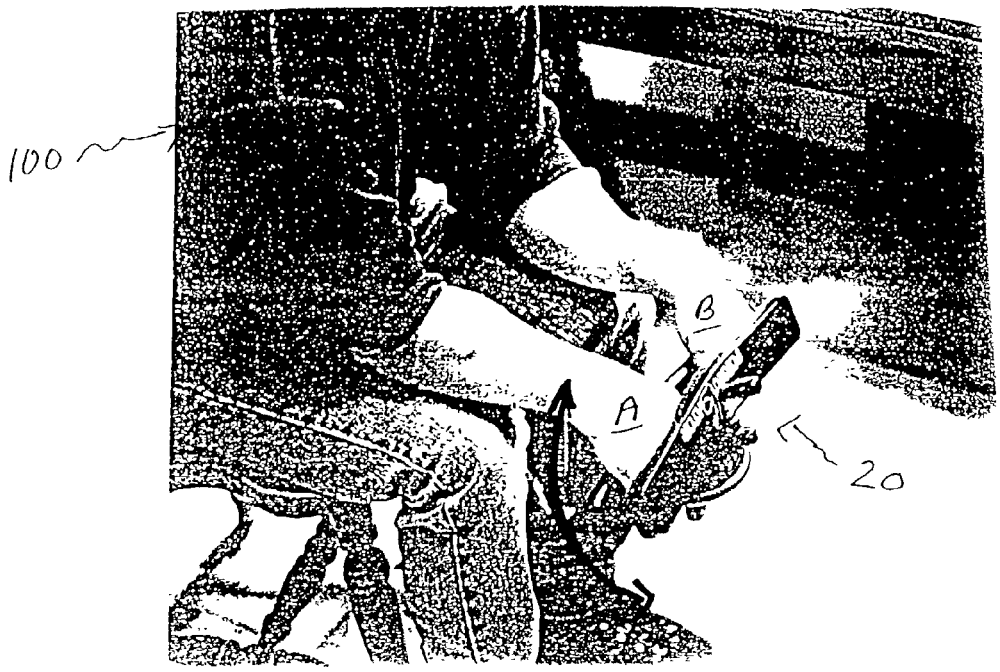
FIGS. 5*a* and 5*b* depict environmental perspective views of one embodiment of the device according to the present invention being used in one set of an exercising protocol in the "palms down" position.
Figure 5B:
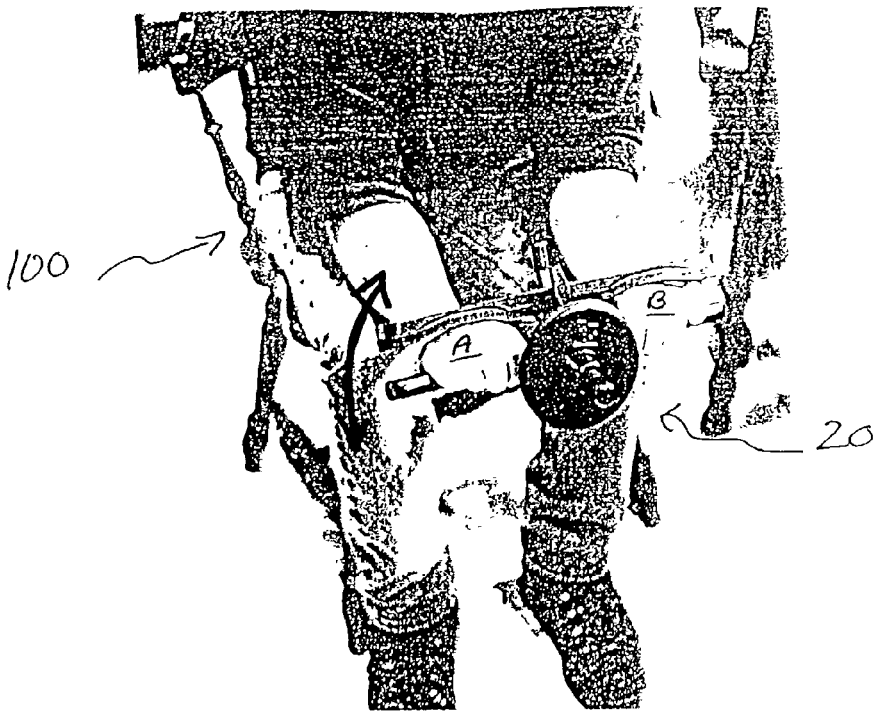

FIGS. 5*a* and 5*b* depict user's 100 palms in the "down" position, where the palms are facing away from user 100, towards the ground or floor. When device 20 is used in an exercise protocol wherein the palms are in the "palms down" position, the muscles, tendon and ligament on the top portion of the forearms, hands and wrists A, B are exercised. The upward and downward pointing arrows depicted in FIGS. 4*a*, 4*b*, 5*a* and 5*b* represent the general rotational movement and range of motion of user's 100 wrists A, B in the course of using device 20 in an appropriately determined exercise protocol or regimen. In a preferred embodiment, user 100 rotates wrists A, B in a relatively slow, deliberate and fluid motion throughout a series of appropriately determined repetitive exercise sets.

Repeated exercise sets using devices 20, 40 as described herein is intended to increase a user's range of motion of the hands and wrists while simultaneously improving muscle strength and condition in the forearms, hands and wrists. By varying the amounts of weight attached to devices 20, 40, various wrist, hand and/or forearm exercise sets performed using the device promote a full range of motion, and develops and strengthens muscles in the wrists, hands, and forearms. Additionally, because devices 20, 40 enable the wrists, hands and forearms to work together, a user is able to exercise an injured wrist, hand or forearm with the assistance of the uninjured wrist, hand or forearm, thereby reducing the overall duration of time needed for rehabilitation and recovery.

Devices 20, 40 can be made from a variety of materials including, but not limited to, various synthetic and natural rubbers; plastics, such as ABS and plastic cellular foam materials; metals, such as steel, brass and chromium; composite materials; and various combinations thereof.

While the invention has been described with reference to preferred embodiments, it will be understood by those skilled in the art that various changes may be made and equivalents may be substituted for elements thereof without departing from the scope of the invention. For example, as those skilled in the art will no doubt recognize, other means of carrying out attachment of weight 60 and adjustable locking bar 25 to post 26 are contemplated, without departing from the spirit of the subject invention. In addition, many modifications may be made to adapt a particular situation or material to the teachings of the invention without departing from the scope of the invention.

Therefore, it is intended that the invention not be limited to the particular embodiments disclosed as the best mode contemplated for carrying out this invention, but that the invention will include all embodiments falling within the scope and spirit of the appended claims.

The invention claimed is:

1. A handheld exercise device for exercising, rehabilitating and strengthening the muscles, tendons and ligaments in the hands, wrists and forearms while improving the full range of motion for these affected regions, said device comprising:

an elongated adjustable locking member having a lower cushioned hand pad portion and an upper hand pad base, adjustably connected to an elongated finger grip bar;

wherein said finger grip bar includes a finger grip receiving edge extending around the perimeter of said finger grip receiving bar, said finger grip receiving edge includes at least one weight supporting post mounted thereto; and a weight slidably mounted onto each of said weight mounting posts;

wherein said elongated adjustable locking member further comprises:

an inner surface, an outer surface, and an outer edge surface;

said lower cushion hand pad portion fixedly attached to said inner surface of said elongated adjustable locking member;

a central orifice extending through said inner and said outer surface of said elongated adjustable locking member, configured for receiving a connecting post; and a locking orifice extending from said outer edge surface to the central shaft orifice, configured for receiving a connecting post locking means.

2. The handheld exercise device as set forth in claim 1, wherein said hand pad portion of said elongated adjustable locking member is shaped to match the contour of the top of a human hand.

3. The handheld exercise device as set forth in claim 1, wherein said finger grip receiving edge further comprises:

an upper grip portion; and said weight supporting post of said finger grip receiving bar mounted in the center of said upper grip portion of said finger grip receiving edge, extending out and away from said upper grip portion.

4. The hand held exercise device as set forth in claim 1, wherein said finger grip receiving edge further comprises:

a first end and a second end; and said weight supporting posts of said finger grip receiving bar are mounted in said first end and said second end of said finger grip receiving edge, extending out and away from said first end and said second end.

5. The handheld exercise device as set forth in claim 1, wherein said finger grip bar and said locking bar are V-shaped, having at least a 5° angle from the top of the V to the outermost sides of the V.

6. The handheld exercise device as set forth in claim 1 wherein said finger grip bar includes a finger grip means for receiving both hands.

7. A hand held exercise device for exercising, rehabilitating and strengthening the muscles, tendons and ligaments in the hands, wrists and forearms while improving the full range of motion for these affected regions, said device comprising:

an elongated adjustable locking member having a lower cushioned hand pad portion and an upper hand pad base, adjustably connected to an elongated finger grip bar;

wherein said finger grip bar includes a finger grip receiving edge extending around the perimeter of said finger grip receiving bar, said finger grip receiving edge includes at least one weight supporting post mounted thereto; and a weight slidably mounted onto each of said weight mounting posts;

wherein said finger grip bar further comprises:

an inner surface and an outer surface; and a central orifice extending through said inner and said outer surface of said finger grip receiving bar, configured for receiving a connecting post for adjustably connecting said finger grip receiving bar to said elongated adjustable locking member.

* * * * *